US009816539B1

(12) United States Patent
Petricio Yaksic

(10) Patent No.: US 9,816,539 B1
(45) Date of Patent: Nov. 14, 2017

(54) MOTION CONTROL

(71) Applicant: Davor Petricio Yaksic, Antofagasta (CL)

(72) Inventor: Davor Petricio Yaksic, Antofagasta (CL)

( * ) Notice: Subject to any disclaimer, the term of this patent is extended or adjusted under 35 U.S.C. 154(b) by 585 days.

(21) Appl. No.: 14/219,666

(22) Filed: Mar. 19, 2014

Related U.S. Application Data

(60) Provisional application No. 61/803,245, filed on Mar. 19, 2013.

(51) Int. Cl.
*F15B 11/22* (2006.01)
*F15B 15/20* (2006.01)

(52) U.S. Cl.
CPC ..... *F15B 15/204* (2013.01); *F15B 11/22* (2013.01)

(58) Field of Classification Search
CPC ..... F15B 11/22
See application file for complete search history.

(56) References Cited

U.S. PATENT DOCUMENTS

| | | | | |
|---|---|---|---|---|
| 610,256 | A | 9/1898 | Brown | |
| 2,283,447 | A | 5/1942 | MacMillin | |
| 2,302,132 | A | 11/1942 | MacMillin | |
| 2,861,449 | A | 11/1958 | Cohan | |
| 2,891,636 | A | 6/1959 | Krieger | |
| 3,768,400 | A | 10/1973 | Gygli | |
| 3,855,794 | A | 12/1974 | Meyer | |
| 4,192,222 | A | 3/1980 | Dits | |
| 4,230,304 | A | 10/1980 | Tol | |
| 4,624,126 | A | 11/1986 | Avila | |
| 4,784,058 | A | 11/1988 | Nakagawa | |
| 4,832,315 | A | 5/1989 | Vanderklaauw | |
| 4,873,923 | A | 10/1989 | Manning | |
| 5,013,011 | A | 5/1991 | Halloway | |
| 5,018,925 | A | 5/1991 | Ganser | |
| 5,065,844 | A | 11/1991 | Hon | |
| 5,119,906 | A | 6/1992 | Kondratuk | |
| 5,156,782 | A | 10/1992 | Ballantyne | |
| 5,533,595 | A | 7/1996 | Narumi | |
| 5,735,201 | A | 4/1998 | Hirao | |
| 6,193,016 | B1 | 2/2001 | Hollowell | |
| 6,345,695 | B1 | 2/2002 | Fargo | |
| 6,345,970 | B1 * | 2/2002 | Mitamura | B29D 30/0662 425/28.1 |
| 6,659,192 | B2 * | 12/2003 | Coenen | F15B 11/22 172/439 |
| 6,742,628 | B2 | 6/2004 | Bauer | |
| 7,269,949 | B1 * | 9/2007 | Petricio Yaksic | F15B 11/22 100/258 R |

* cited by examiner

*Primary Examiner* — F. Daniel Lopez
(74) *Attorney, Agent, or Firm* — James Creighton Wray

(57) ABSTRACT

Motion of rams in fluid cylinders to drive machine parts is equalized by equalization chambers between drive chambers for equalizing outward and inward driven motion of the rams and the attached machine parts, irrespective of portions of loads and forces on the machine parts in relation to the rams. Duplicated machine parts may be closely positioned or widely separated, while providing the same controlled equalized movement irrespective of loading. The movable elements may be tilted to new angular positions before they are translated by the rams.

13 Claims, 6 Drawing Sheets

MOTION CONTROL

This application claims the benefit of U.S. Provisional Application No. 61/803,245 filed Mar. 19, 2014, which is hereby incorporated by reference in its entirety as if fully set forth herein.

SUMMARY OF THE INVENTION

In a system for controlling movement of machine parts having a fixed machine part and a movable machine part, first and second rams are connected to the movable machine part.

First and second cylinders are connected respectively to the fixed machine part and to the first and second rams.

First and second opposed drive chambers are in each of the cylinders.

Opposed third and fourth equalizing chambers are in each of the cylinders.

Fluid interconnections are between a fluid pressure source and a three-position four-way valve and between a fluid receiver and the three-position four-way valve.

A first fluid conduit connects the three-position valve and the first drive chambers.

A second fluid conduit connects the second drive chambers and the three-position valve.

A third fluid conduit connects the third chamber of the first cylinder and the fourth chamber of the second cylinder.

A fourth fluid conduit connects the fourth chamber of the first cylinder and the third chamber of the second cylinder for equalizing movement of the first and second rams.

The first and second opposed drive chambers are outer chambers in the cylinders. A pilot check valve in the first conduit adjacent the three-position four-way valve allows fluid to flow from the pilot check valve to the first chambers when the three-position valve is in a first position.

The pilot check valve has a pilot line connected to the second fluid conduit near the three-position valve so that when the three-position valve is in a third position, the pilot line allows pressure from the pressure source to open the check valve to permit fluid to flow from the first conduit to the fluid receiver.

The machine may take any form, such as a press, shear or press brake.

A second three-position four-way valve is connected between the fluid pressure source and to the fluid receiver and the third and fourth fluid conduits for tilting opposite sides of the movable machine parts upward and downward when the second three-position valve is in a first position or in a third position.

Third and fourth pilot check valves are connected in the third and fourth interconnections near the second three-position valve.

The system controls movement of a movable plane in a machine having a stationary bed and movable planes.

First, second, third and fourth rams are connected to a movable planar device remote from each other to move the planar device between parallel positions and to selectively rotate the planar device around crossed axes.

First and second opposed drive chambers are in each of the cylinders.

Third and fourth equalizing chambers are in each of the cylinders.

First, second and third three-position four-way valves are connected to the fluid pressure source and the fluid receiver.

First and second fluid conduits are connected to the first three-position valve.

Third and fourth fluid conduits are connected to the second three-position valve.

Fifth and sixth fluid conduits are connected to the third three-position valve.

The first fluid conduit is connected to the first chambers in the first, second, third and fourth cylinders.

The second fluid conduit is connected to the second chambers in the first, second, third and fourth cylinders.

The third fluid conduit is connected between the third chamber in the first cylinder and the fourth chamber in the third cylinder.

The fourth fluid conduit is connected between the fourth chamber in the first cylinder and the third chamber in the third cylinder.

The fifth fluid conduit is connected between the third chamber in the second cylinder and the fourth chamber in the fourth cylinder.

The sixth fluid conduit is connected between the fourth chamber in the second cylinder and the third chamber in the fourth cylinder.

The second position of the three-position valve is neutral with no connection to the chambers.

Placing the first three-position valve in a first position connects the fluid pressure source to the first conduit and to all of the first chambers and connects the second conduit and all of the second chambers to the fluid reservoir to provide outward movement of the movable plane. Fluid flows in the third, fourth, fifth and sixth conduits between the respective third and fourth chambers of the cylinders to equalize movement of the rams.

Placing the first three-position valve in a third position connects the fluid pressure source to the second conduit and to all of the second chambers, connects the first conduit and all of the first chambers to the fluid reservoir, and provides inward movement of the movable plane. Fluid flows in the third, fourth, fifth and sixth conduits between the respective third and fourth chambers of the cylinders to equalize movement of the rams.

Moving the second three-position valve to a first position connects the fluid pressure source to the third fluid conduit and connects the fourth fluid conduit to the fluid reservoir for tilting the planar device clockwise about a first axis between connections of the second and fourth rams to the planar device. Moving the second three-position valve to a third position connects the fluid pressure source to the fourth fluid conduit and connects the third fluid conduit to the fluid reservoir for tilting the planar device counterclockwise about the first axis.

Moving the third three-position valve to a first position connects the fluid pressure source to the fifth fluid conduit and connects the sixth fluid conduit to the fluid reservoir for tilting the planar device clockwise about a second axis between connections of the first and third rams to the planar device. Moving the third three-position valve to a third position connects the fluid pressure source to the sixth fluid conduit and connects the fifth fluid conduit to the fluid reservoir for tilting the planar device counterclockwise about the second axis.

First, third, fourth, fifth and sixth pilot check valves connected respectively to the first, third, fourth, fifth and sixth fluid conduits near the three-position valves open respective ones of the check valves when the first three-position valve is in the third position, or when the second or third check valve is either in the first or third position.

The machine may be a press and the movable planar device may be a platen. The machine may be a sheet metal former, such as used in the vehicle manufacturing industries.

The machine may be a long press brake such as a twelve meter press brake with four driven rams.

The system may angularly move elements such as large doors or aircraft control surfaces.

First and second spaced pivots mount the element, and first and second spaced pivoted plates are connected to the pivots.

First and second rams have devises connected to the first plate for moving the first plate.

Third and fourth rams are connected for moving the second plate.

First and second cylinders are connected to the first and second rams.

Third and fourth cylinders are connected to the third and fourth rams for moving the second plate.

Each of the cylinders has opposed first outer driving chambers and second inner equalizing chambers.

A fluid pressure source has a fluid delivery line.

A fluid receiver has a fluid return line.

A three-position four-way valve is connected to the fluid delivery line and to the fluid return line.

A first fluid line is connected to the three-position valve and to the first chambers of the first and third cylinders.

A second fluid line is connected to the three-position valve and to the first chambers of the second and fourth cylinders.

A third fluid line is connected to the second chambers of the first and fourth cylinders.

A fourth fluid line is connected to the second chambers of the second and third cylinders.

The first chambers drive the rams connected to the plates and the second chambers equalize movement of rams connected to the plates. The third and fourth fluid lines have a valved interconnection line. Opening the valve in the interconnection line allows the plates to be relatively moved.

In one machine, the plates are connected to airplane flaps and the cylinders are connected so that the plates on opposite sides of an airplane are interconnected with the fluid lines to move equally in the same sense of rotation.

When the plates are connected to airplane ailerons, the fluid lines are connected between plates on opposite sides of the airplane to concurrently move the ailerons equally in opposite senses of rotation.

A system that controls movement of machine parts has a fixed machine part and a movable machine part. First and second rams are connected to the movable machine part. First and second cylinders are connected respectively to the first and second rams. First and second opposed drive chambers are in each of the cylinders. Third and fourth opposed equalizing chambers are in each of the cylinders. The system has a fluid pressure source, a fluid receiver and a three-position four-way valve.

The system has fluid interconnections between the fluid pressure source and the three-position four-way valve and between the fluid receiver and the three-position four-way valve. A first fluid conduit is situated between the three-position valve and the first drive chambers. A second fluid conduit is situated between the second drive chambers and the three-position valve. A third fluid conduit is situated between the third chamber of the first cylinder and the fourth chamber of the second cylinder. A fourth fluid conduit is situated between the fourth chamber of the first cylinder and the third chamber of the second cylinder for equalizing movement of the first and second rams.

First and second opposed drive chambers may be outer chambers in the cylinders. A pilot check valve is connected in the first conduit adjacent the three-position four-way valve for allowing fluid to flow from the pilot check valve to the first chambers when the three-position valve is in a first position. The pilot check valve has a pilot line connected to the second fluid conduit near the three-position valve when the three-position valve is in a third position, allowing pressure from the pressure source to open the check valve to permit fluid to flow from the first conduit to the fluid receiver. In each of the cylinders the first chambers and third chambers are separated by a first movable piston. The second and fourth chambers are separated by a second movable piston. The third and fourth chambers are separated by a divider fixed in each of the cylinders. The first and second pistons are connected to one of the rams that is movable through and is sealed for movement through the divider. The third and fourth fluid conduits equalize the movements of the first and second rams.

The machine is a press, shear or press brake. A second three-position four-way valve is connected between the fluid pressure source and to the fluid receiver and the third and fourth fluid conduits for tilting opposite sides of the movable machine parts upward and downward when the second three-position valve is in a first position or in a third position. Third and fourth pilot check valves are connected in the third and fourth interconnections near the second three-position valve.

The system controls movement of a movable planar device in a machine with stationary and movable planes. First, second, third and fourth rams are connected to the planar device remote from each other to move the planar device between parallel positions and to selectively rotate the planar device around crossed axes. First and second opposed drive chambers are in each of the cylinders. Third and fourth equalizing chambers are in each of the cylinders. The system has a fluid pressure source and a fluid receiver. First, second and third three-position four-way valves are connected to the fluid pressure source and the fluid receiver. First and second fluid conduits are connected to the first three-position valve. Third and fourth fluid conduits are connected to the second three-position valve. Fifth and sixth fluid conduits are connected to the third three-position valve. The first fluid conduit is connected to the first chambers in the first, second, third and fourth cylinders. The second fluid conduit is connected to the second chambers in the first, second, third and fourth cylinders. The third fluid conduit is connected between the third chamber in the first cylinder and the fourth chamber in the third cylinder. The fourth fluid conduit is connected between the fourth chamber in the first cylinder and the third chamber in the third cylinder. The fifth fluid conduit is connected between the third chamber in the second cylinder and the fourth chamber in the fourth cylinder. The sixth fluid conduit is connected between the fourth chamber in the second cylinder and the third chamber in the fourth cylinder.

Placing the first three-position valve in a first position connects the fluid pressure source to the first conduit and to all of the first chambers, and connects the second conduit and all of the second chambers to the fluid reservoir, to provide outward movement of the movable plane while fluid flows in the third, fourth, fifth and sixth conduits between the respective third and fourth chambers of the cylinders to equalize movement of the rams.

Placing the first three-position valve in a third position connects the fluid pressure source to the second conduit and to all of the second chambers, and connects the first conduit and all of the first chambers to the fluid reservoir, to provide inward movement of the movable plane while fluid flows in the third, fourth, fifth and sixth conduits between the respective third and fourth chambers of the cylinders to equalize movement of the rams.

The second three-position valve is moved to a first position for connecting the fluid pressure source to the third fluid conduit, and for connecting the fourth fluid conduit to the fluid reservoir for tilting the planar device clockwise about a first axis between connections of the second and fourth rams to the planar device. The second three-position valve is moved to a third position, connects the fluid pressure source to the fourth fluid conduit, and connects the third fluid conduit to the fluid reservoir for tilting the planar device counterclockwise about the first axis between the connections of the second and fourth rams to the planar device.

The third three-position valve is moved to a first position for connecting the fluid pressure source to the fifth fluid conduit, and for connecting the sixth fluid conduit to the fluid reservoir for tilting the planar device clockwise about a second axis between connections of the first and third rams to the planar device. The third three-position valve is moved to a third position for connecting the fluid pressure source to the sixth fluid conduit, and connecting the fifth fluid conduit to the fluid reservoir for tilting the planar device counterclockwise about the second axis between the connections of the first and fourth rams to the planar device.

The system has first, third, fourth, fifth and sixth pilot check valves connected respectively to the first, third, fourth, fifth and sixth fluid conduits near the three-position valves for opening respective ones of the check valves when the first three-position valve is in the third position, or when the second or third check valve is in the first or third position. The machine is a press and the movable planar device is a platen.

A system for angularly moving elements has first and second spaced pivots connected to a structure for mounting the elements relative to the structure. First and second spaced pivoted elements are connected to the pivots. First and second rams have devises connected to the first element for moving the first element. Third and fourth rams are connected to the second element. First and second cylinders are connected to the first and second rams. Devices connect the first and second cylinders to the structure spaced from the pivots. Third and fourth cylinders are connected to the third and fourth rams for moving the second element Each of the cylinders has opposed first driving chambers and second inner equalizing chambers. A fluid pressure source has a fluid delivery line. A fluid receiver has a fluid return line. A three-position four-way valve is connected to the fluid delivery line and to the fluid return line. A first fluid line is connected to the three-position valve and the first driving chambers of the first and third cylinders. A second fluid line is connected to the three-position valve and to the first driving chambers of the second and fourth cylinders. A third fluid line is connected to the second equalizing chambers of the first and fourth cylinders. A fourth fluid line is connected to the second equalizing chambers of the second and third cylinders. The first driving chambers drive the rams connected to the plates and the second equalizing chambers equalize movement of rams connected to the elements.

The third and fourth fluid lines have a valved interconnection line. Opening the valve in the interconnection line allows the elements to be relatively moved.

In examples, the elements are connected to airplane flaps and the cylinders are connected to an airplane. The elements on opposite sides of an airplane are interconnected with the fluid lines to move equally in the same sense of rotation. The elements are connected to airplane ailerons, and the fluid lines are connected between cylinders on opposite sides of the airplane to concurrently move the ailerons equally in opposite senses of rotation.

These and further and other objects and features of the invention are apparent in the disclosure, which includes the above and ongoing written specification, with the claims and the drawings.

DETAILED DESCRIPTION OF THE DRAWINGS

Figure 1:
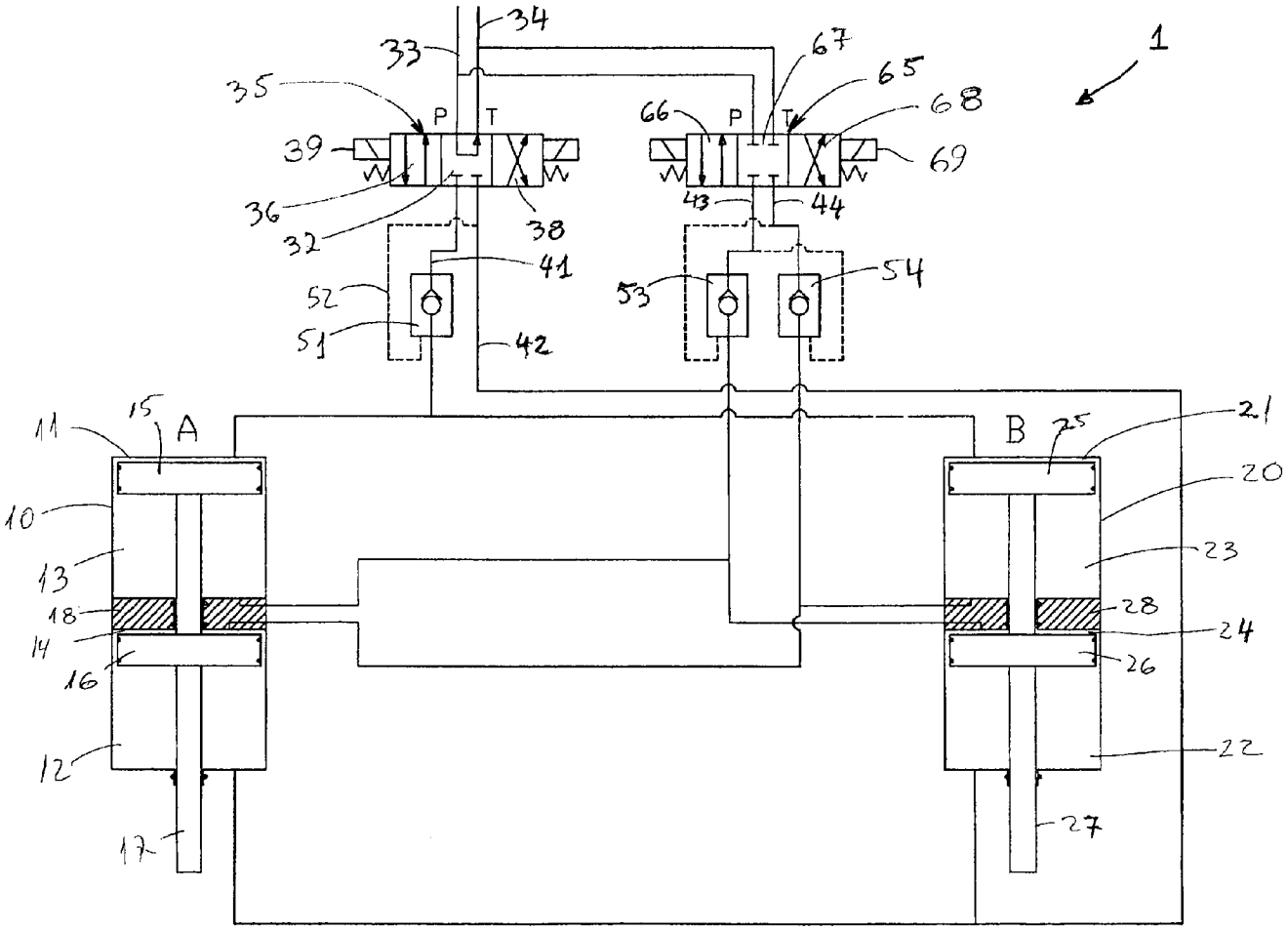
FIG. 1 schematically shows a system for controlling movement of machine parts by equalizing movement of rams, with a minor control, such as is useful for industrial shears, press brakes and presses.

FIG. 1 schematically shows a system 1 for controlling movement of machine parts by equalizing movement of rams 17, 27, with a control 35, such as is useful for industrial shears, press brakes and presses, for example.

An advantage of the new motion control is that it is easy to control with simple up and down buttons or with a computer. For example, if the desired displacement of the machine is determined, the computer may stop the machine after the displacement and return the machine simply by moving three-position valve 35 with a solenoid 39. If the machine needs to work on a heavier piece, the computer may adjust the angle of the movable part by changing three-position valve 65 with solenoid 69.

In a system 1 for controlling movement of machine parts having a fixed machine part and a movable machine part, first and second rams 17, 27 are connected to the movable machine part.

First and second cylinders A, B, 10, 20 are connected respectively to the fixed machine part and to the first and second rams 17, 27.

First and second opposed drive chambers 11, 12; 21, 22 are in each of the cylinders 10, 20.

Opposed third and fourth equalizing chambers 13, 14; 23, 24 are in the cylinders 10, 20, respectively. Pistons 15 and 16 on opposite sides of divider 18 separate the chambers and are connected to the first ram 17. Similar pistons 25, 26 and divider 28 in cylinder 30 form the chambers. Ram 27 is connected to pistons 25, 26.

Fluid interconnections 31, 32 are between a fluid pressure source 33 and a three-position four-way valve 35 and between a fluid receiver 34 and the three-position four-way valve. The three-position valve 35 has a first active position 36, a second neutral position 37, and a third reverse position 38.

A first fluid conduit 41 connects the three-position valve 35 and the first drive chambers 11, 21.

A second fluid conduit 42 connects the second drive chambers 12, 22 and the three-position valve 35.

A third fluid conduit 43 connects the third chamber 13 of the first cylinder 10 and the fourth chamber 24 of the second cylinder 20.

A fourth fluid conduit 44 connects the fourth chamber 14 of the first cylinder 10 and the third chamber 23 of the second cylinder 20 for equalizing movement of the first and second rams 17, 27.

The first and second opposed drive chambers 11, 21; 12, 22 are outer chambers in the cylinders 10, 20. A pilot check valve 51 in the first conduit 41 adjacent the three-position four-way valve 35 allows fluid to flow from the pilot check valve 51 to the first chambers 11, 21 when the three-position valve 35 is in a first position 36.

The pilot check valve 51 has a pilot line 52 connected to the second fluid conduit 42 near the three-position valve 35 so that when the three-position valve is in a third position 38, the pilot line 52 allows pressure from the pressure source 33 to open the pilot check valve 51 to permit fluid to flow from the first conduit 41 to the fluid receiver 34.

The machine may take any form, such as a press, shear or press brake.

A second three-position four-way valve 65 is connected between the fluid pressure source 33 and to the fluid receiver 34 and the third and fourth fluid conduits 43, 44 for tilting opposite sides of the movable machine parts upward and downward when the second three-position valve 65 is in a first position 66 or in a third position 68. Second position 67 is neutral.

Third and fourth pilot check valves 53 54 are connected in the third and fourth conduits 43, 44 near the second three-position valve 65.

Figure 2:
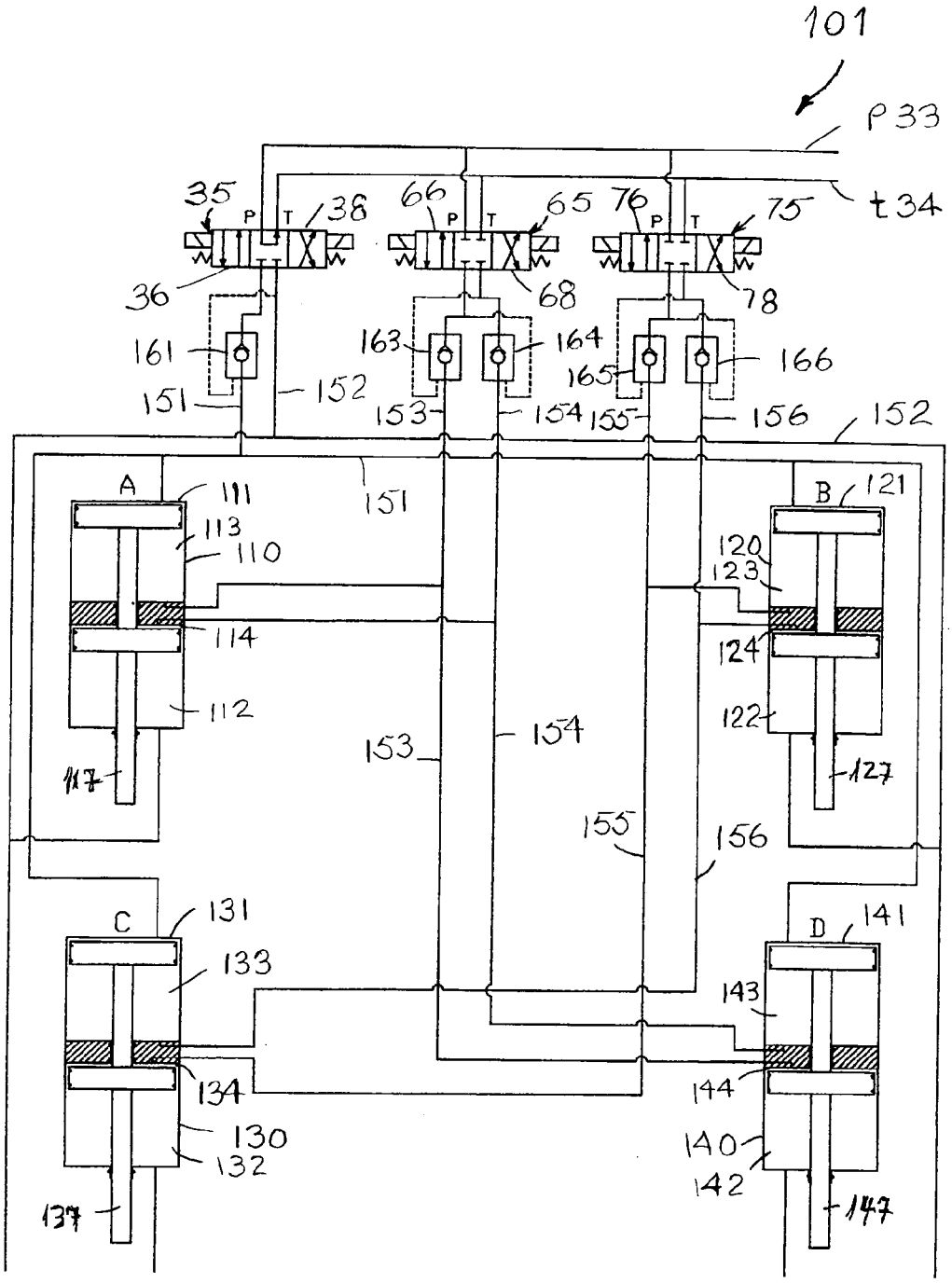
FIG. 2 is a schematic representation of a system for moving a platform in pure translation between parallel spaced positions by equalizing movement of rams, with an ability to rotate the positions around two axes which is useful, for example, in shaping sheet metal such as for automobiles.

FIG. 2 is a schematic representation of a modified system 101 for moving a platform in pure translation between parallel spaced positions by equalizing movement of rams 117, 127, 137, 147, with an ability to rotate the platen around two axes which is useful, for example, in shaping sheet metal such as for automobiles.

Figure 3:
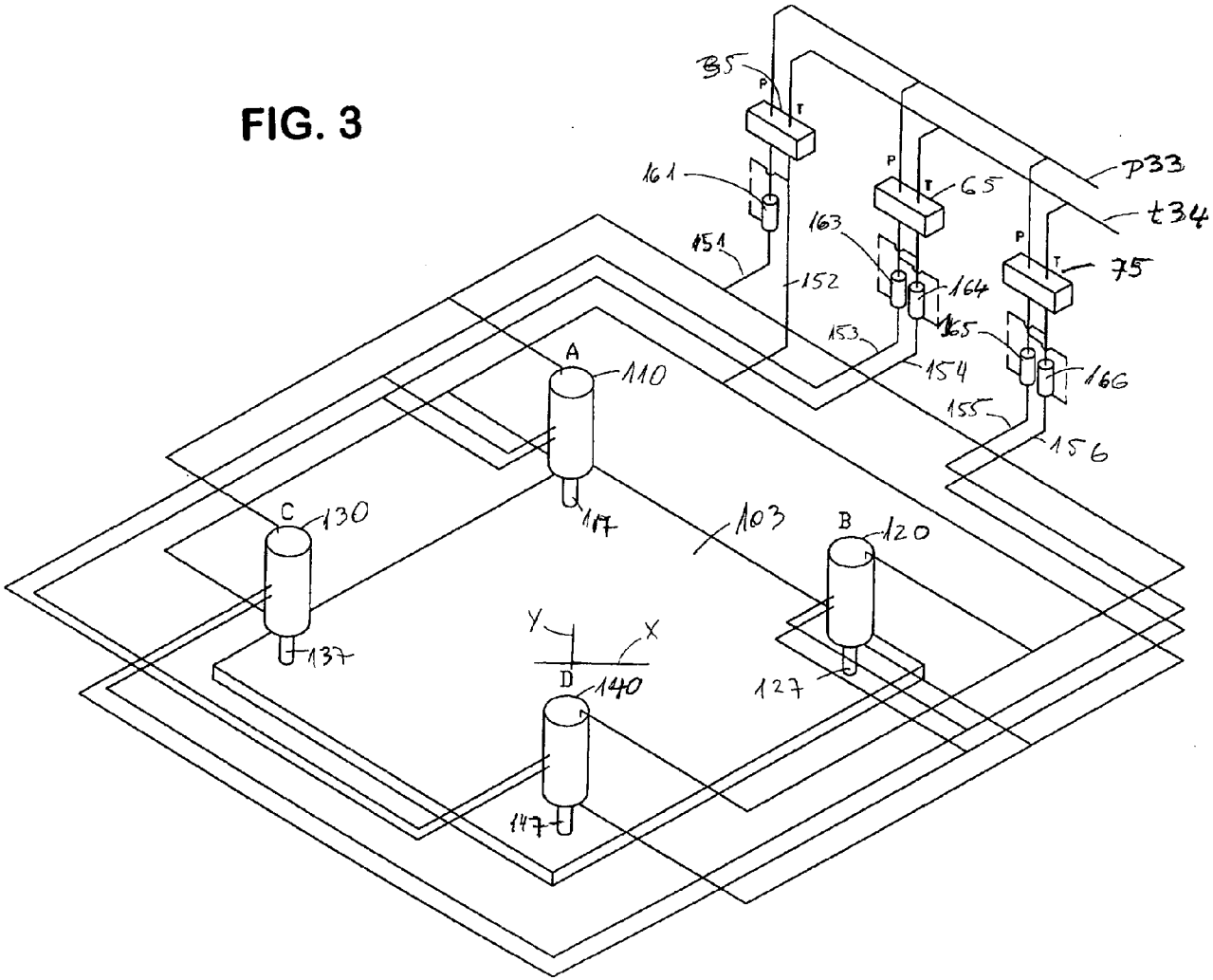
FIG. 3 is a schematic representation of the system of FIG. 2 showing cylinder chambers, pistons, rams and three-position valves.

FIG. 3 is a schematic representation of the system 101 of FIG. 2 showing cylinder chambers, pistons, rams and three-position valves.

A slightly modified system 101 controls movement of a movable plane in a machine having a stationary bed connected to cylinders A, B, C, D, 110, 120, 130, 140 and movable planar elements 103.

First 117, second 127, third 137 and fourth 147 rams are connected to a movable planar device 103 remote from each other to move the planar device between parallel positions and to selectively rotate the planar device around crossed axes.

First and second opposed drive chambers similar to the drive chambers shown in FIG. 1 are in each of the cylinders 110, 120, 130, 140. Third and fourth equalizing chambers are in each of the cylinders, similar to the equalizing chambers in FIG. 1.

As shown in FIGS. 2 and 3, first 35, second 65 third 75 three-position four-way valves are connected to the fluid pressure source p33 and the fluid receiver t34.

First and second fluid conduits 151, 152 are connected to the first three-position valve 35.

Third and fourth fluid conduits 153, 154 are connected to the second three-position valve 65.

Fifth and sixth fluid conduits 155, 156 are connected to the third three-position valve 75.

The first fluid conduit 151 is connected to the first chambers 111, 121, 131, 141 in the first, second, third and fourth cylinders 110, 120, 130, 140.

The second fluid conduit 152 is connected to the second chambers 112, 122, 132, 142 in the first, second, third and fourth cylinders.

The third fluid conduit 153 is connected between the third 113 chamber in the first cylinder 110 and the fourth chamber 144 in the third 130 cylinder.

The fourth fluid conduit 154 is connected between the fourth 114 chamber in the first cylinder 110 and the third chamber 143 in the fourth cylinder 140.

The fifth fluid conduit 155 is connected between the third chamber 123 in the second cylinder and the fourth chamber 134 in the third cylinder 130.

The sixth fluid conduit 156 is connected between the fourth chamber 124 in the second cylinder 120 and the third chamber 133 in the third cylinder 130.

The second positions of the three-position valves are neutral with no connection to the chambers.

Placing the first three-position valve 35 in a first position 36 connects the fluid pressure source p33 to the first conduit 151 and to all of the first chambers 111, 121, 131, 141 and connects the second conduit 152 and all of the second chambers 112, 122, 132, 143 to the fluid reservoir t34 to provide outward movement of the movable plane 103. Fluid flows in the third 153, fourth 154, fifth 155 and sixth 156 conduits between the respective third and fourth chambers of the cylinders to equalize movement of the rams 117, 127, 137, 147.

Placing the first three-position valve 35 in a third position 38 connects the fluid pressure source 33 to the second conduit 152 and to all of the second chambers 112, 122, 132, 142, connects the first conduit 151 and all of the first chambers 111, 121, 131, 141 to the fluid reservoir t34, and provides inward movement of the movable plane 103. Fluid flows in the third 153, fourth 154, fifth 155 and sixth 156 conduits between the respective third and fourth chambers of the cylinders to equalize movement of the rams 117, 127, 137, 147.

Moving the second three-position valve 65 to a first position 66 connects the fluid pressure source 33 to the third fluid conduit 153 and connects the fourth fluid conduit 154 to the fluid reservoir 34 for tilting the planar device 103 clockwise about a first axis X between connections of the second 127 and third 137 rams to the planar device 103. Moving the second three-position valve 65 to a third position 68 connects the fluid pressure source 33 to the fourth fluid conduit 154 and connects the third fluid conduit 153 to the fluid reservoir 34 for tilting the planar device 103 counterclockwise about the first axis.

Moving the third three-position valve 75 to a first position 76 connects the fluid pressure source 33 to the fifth fluid conduit 155 and connects the sixth fluid conduit 156 to the fluid reservoir 34 for tilting the planar device 103 clockwise about a second axis Y between connections of the first 117 and fourth 147 rams to the planar device 103. Moving the third three-position valve 75 to a third position 78 connects the fluid pressure source 33 to the sixth fluid conduit 156 and connects the fifth fluid conduit 155 to the fluid reservoir 34 for tilting the planar device 103 counterclockwise about the second axis Y.

First 161, third 163, fourth 164, fifth 165 and sixth 166 pilot check valves connected respectively to the first, third, fourth, fifth and sixth fluid conduits near the three-position valves open respective ones of the check valves when the first three-position valve 35 is in the third position 38, or when the second 65 or third 75 check valve is either in the first 66, 76 or third position 68, 78.

The machine may be a press and the movable planar device 103 may be a platen. The machine may be a sheet metal former, such as used in the vehicle manufacturing industries. The machine may be a long press brake such as a twelve meter press brake with four driven rams.

Figure 4:
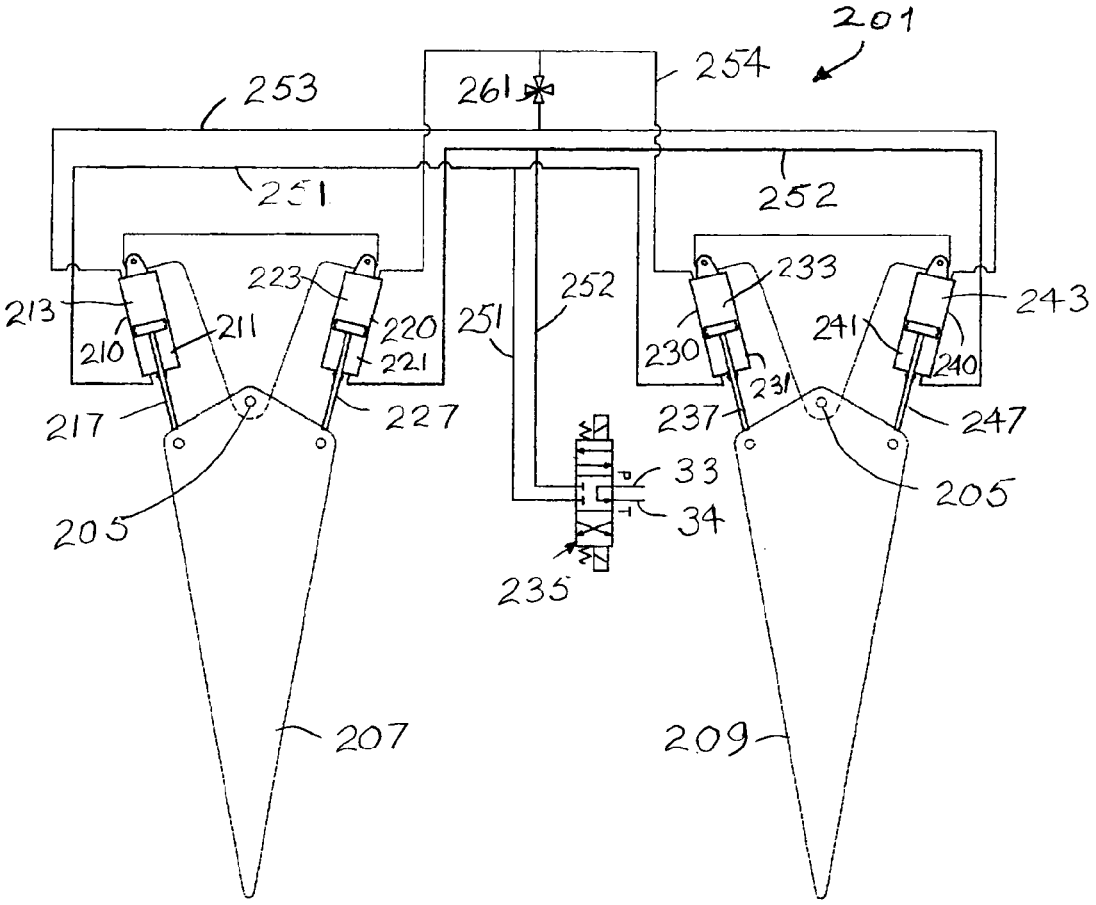
FIG. 4 is a schematic representation of a system for moving elongated objects about pivot points, such as may be used for moving doors or for moving airplane control surfaces, such as flaps or ailerons.
Figure 5:
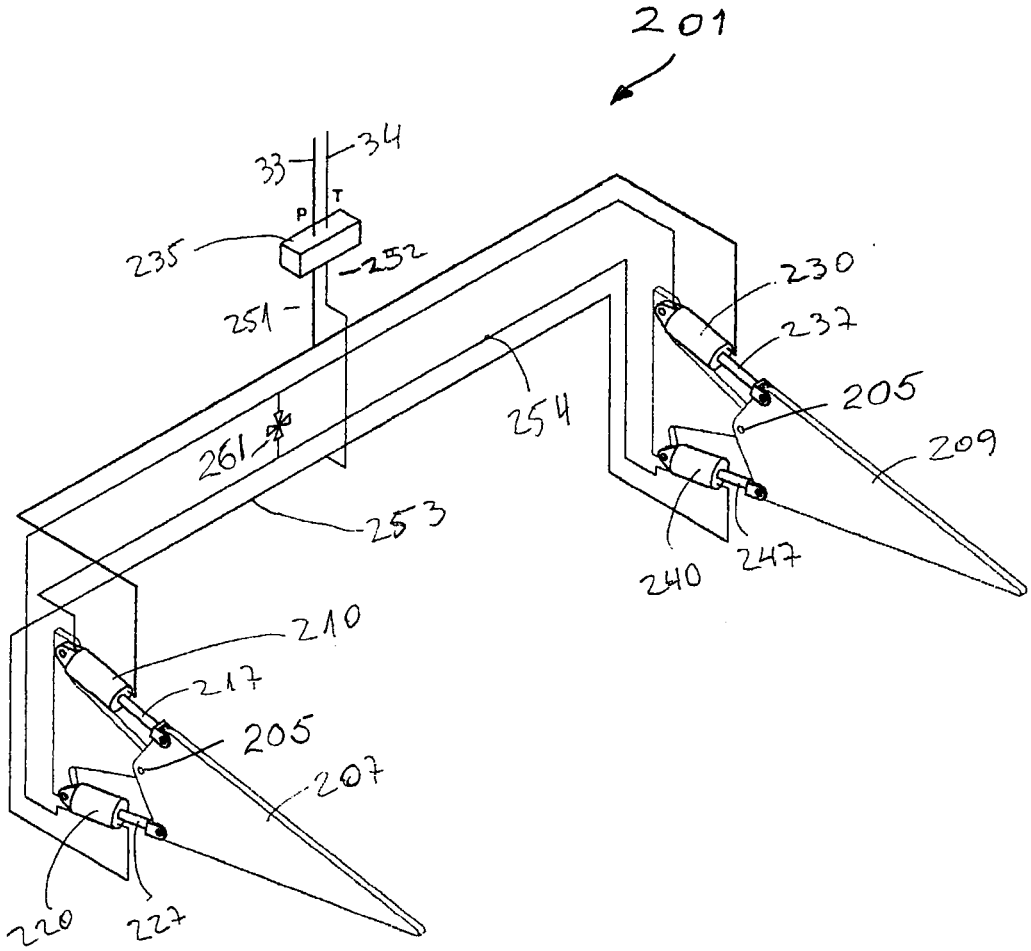
FIG. 5 is a schematic representation of the system in FIG. 5 showing the cylinders, pistons and rams and equalizing system.

FIGS. 4 and 5 are schematic representations of a system 201 for moving elongated objects about pivot points, such as may be used for moving doors or for moving airplane control surfaces, such as flaps or ailerons.

FIG. 5 is a schematic representation of the system 201 in FIG. 4 showing the cylinders, pistons and rams and equalizing system.

The related system 201 may angularly move elements such as large doors or aircraft control surfaces.

First and second spaced pivots 205 mount the element, and first and second spaced pivoted plates 207, 209 are connected to the pivots.

First and second rams 217, 227 have devises connected to the first plate 207 for moving the first plate.

Third and fourth rams 237, 247 are connected for moving the second plate 209.

First and second cylinders 210, 220 are connected to the first and second rams 217, 227.

Third and fourth cylinders 230, 240 are connected to the third and fourth rams 237, 247 for moving the second plate 209.

Each of the cylinders has opposed first outer driving chambers 211, 221, 231, 241 and second inner equalizing chambers 213, 223, 233, 243.

A fluid pressure source 33 has a fluid delivery line.

A fluid receiver 34 has a fluid return line.

A three-position four-way valve 235 is connected to the fluid delivery line and to the fluid return line.

A first fluid line 251 is connected to the three-position valve 235 and to the first chambers 211, 231 of the first and third cylinders 210, 230.

A second fluid line 252 is connected to the three-position valve 235 and to the first chambers 221, 241 of the second and fourth cylinders 220, 240.

A third fluid line 253 is connected to the second chambers 213, 243 of the first and fourth cylinders 210, 240.

A fourth fluid line 254 is connected to the second chambers 223, 233 of the second and third cylinders 220, 230.

The first chambers 211, 221, 231, 241 drive the rams 217, 227, 237, 247 connected to the plates 207, 209 and the second chambers 213, 223, 233, 243 equalize movement of rams connected to the plates. The third and fourth fluid lines have a valved interconnection line 261. Opening the valve 261 in the interconnection line allows the plates 207, 209 to be relatively rotated.

In one machine, the plates are connected to airplane flaps, and the cylinders are connected so that the plates on opposite sides of an airplane are interconnected with the fluid lines to move equally in the same sense of rotation.

When the plates are connected to airplane ailerons, the fluid lines are connected between plates on opposite sides of the airplane to concurrently move the ailerons equally in opposite senses of rotation.

Figure 6:
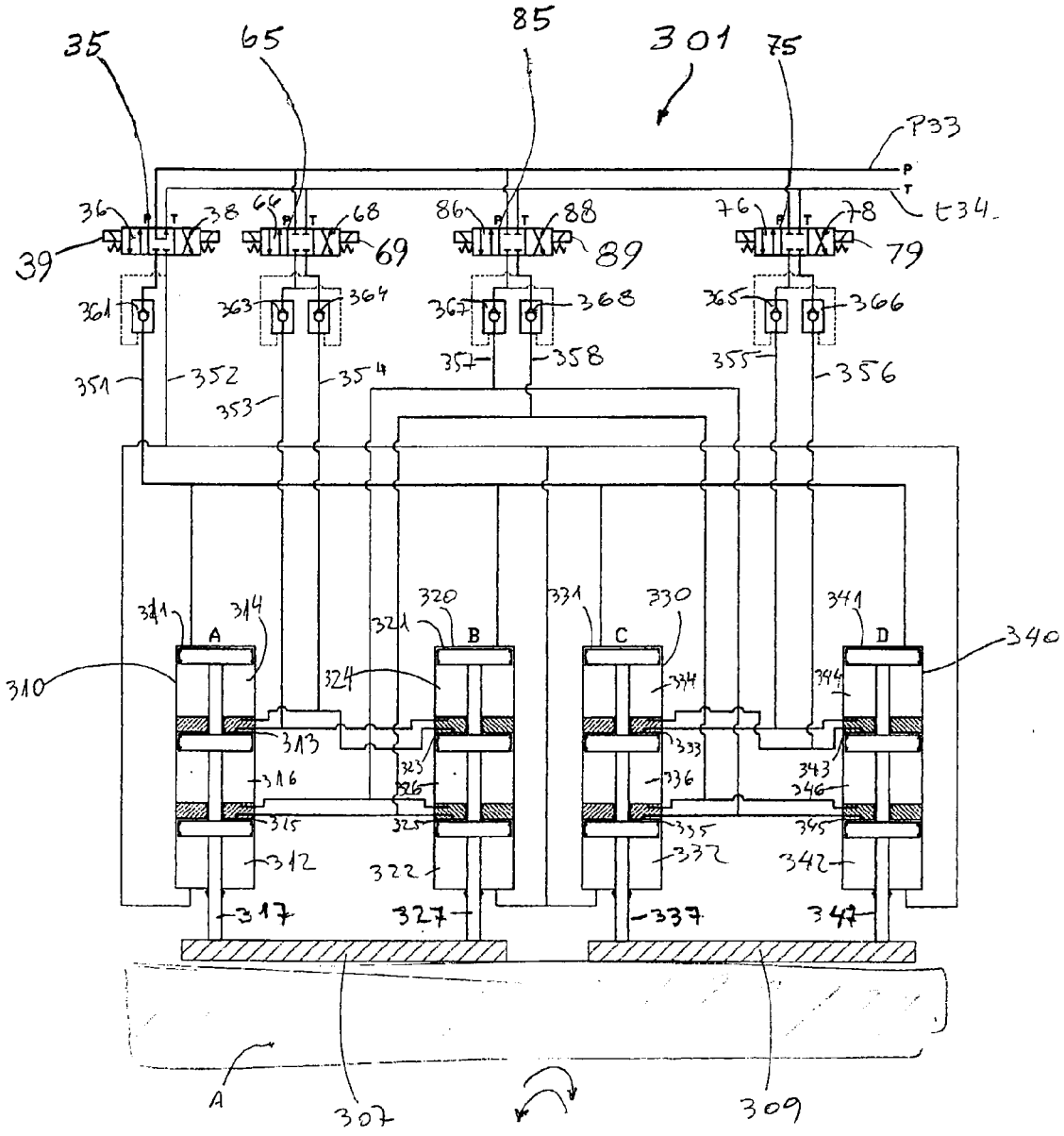
FIG. 6 is a schematic representation of a system moving two separated objects with equal movement of rams and controls for moving, and relatively positioning and tiling the elements.

FIG. 6 is a schematic representation of a system 301 moving two separated objects 307,309 with equal movement of rams 317, 327, 337, 347 and controls for moving and relatively positioning the rams and tiling the elements. FIG. 6 is a schematic representation of a modified system 301 for moving objects 307, 309 in parallel spaced positions by equalizing movement of rams 317, 327, 337, 347, with an ability to rotate the objects, which is useful, for example, in shaping sheet metal such as for automobiles or in long 12 meter press brakes.

The slightly modified system 301 controls movement of a movable object in a machine having a single or multiple movable objects.

First 317, second 327, third 337 and fourth 347 rams are connected to the movable elements 307, 309.

First 311, 321, 331, 341 and second 312, 322, 332, 342 opposed drive chambers are in each of the cylinders 310, 320, 330, 340. Four equalizing chambers are in each of the cylinders.

First 35, second 65, third 85 and fourth 75 three-position four-way valves are connected to the fluid pressure source p33 and the fluid receiver tank t34.

First and second fluid conduits 351, 352 are connected to the first three-position valve 35.

Third and fourth fluid conduits 353, 354 are connected to the second three-position valve 65.

Fifth and sixth fluid conduits 355, 356 are connected to the third three-position valve 75.

Seventh and eighth fluid conduits 357, 358 are connected to the fourth three-position valve 85.

The first fluid conduit 351 is connected to the first chambers 311, 321, 331, 341 in the first, second, third and fourth cylinders 310, 320, 330, 340.

The second fluid conduit 352 is connected to the second chambers 312, 322, 332, 342 in the first, second, third and fourth cylinders.

The third fluid conduit 353 is connected between the third chamber 313 in the first cylinder 310 and the fourth chamber 324 in the second cylinder 320.

The fourth fluid conduit 354 is connected between the fourth chamber 314 in the first cylinder 310 and the third chamber 323 in the second cylinder 320.

The fifth fluid conduit 355 is connected between the third chamber 333 in the third cylinder 330 and the fourth chamber 344 in the fourth cylinder 340.

The sixth fluid conduit 356 is connected between the fourth chamber 334 in the third cylinder 330 and the third chamber 343 in the fourth cylinder 340.

The seventh fluid conduit 357 is connected to the sixth chambers 316, 326 in the first and second cylinders 310, 320, and to the fifth chambers 335, 345 in the third and fourth cylinders 330, 340.

The eighth fluid conduit 358 is connected to the fifth chambers 315, 325 in the first and second cylinders 310, 320, and to the sixth chambers 336, 346 in the third and fourth cylinders 330, 340.

The second positions of the three-position valves are neutral with no connection to the chambers.

Placing the first three-position valve 35 in a first position 36 connects the fluid pressure source p33 to the first conduit 351 and to all of the first chambers 311, 321, 331, 341 and connects the second conduit 352 and all of the second chambers 312, 322, 332, 342 to the fluid reservoir tank t34 to provide outward movement of the movable elements 307, 309. Fluid flows in the third 353, fourth 354, fifth 355 and sixth 356 conduits between the respective third and fourth chambers of the cylinders and in the seventh 357 and eighth 358 between respective fifth six sixth chambers to equalize movement of the rams 317, 327, 337, 347.

Placing the first three-position valve 35 in a third position 38 connects the fluid pressure source 33 to the second conduit 352 and to all of the second chambers 312, 322, 332, 342, connects the first conduit 351 and all of the first chambers 311, 321, 331, 341 to the fluid reservoir tank t34, and provides inward movement of the elements 307, 309. Fluid flows in the third 353, fourth 354, fifth 355 and sixth 356 conduits between the respective third and fourth chambers of the cylinders and in the seventh 357 and eighth 358 between respective fifth six sixth chambers to equalize movement of the rams 317, 327, 337, 347.

Moving the second three-position valve 65 to a first position 66 connects the fluid pressure source 33 to the third fluid conduit 353 and connects the fourth fluid conduit 354 to the fluid reservoir 34 for tilting the object 307 clockwise. Moving the second three-position valve 65 to a third position 68 connects the fluid pressure source 33 to the fourth fluid conduit 354 and connects the third fluid conduit 353 to the fluid reservoir 34 for tilting the object 307 counterclockwise.

Moving the third three-position valve 75 to a first position 76 connects the fluid pressure source p33 to the fifth fluid conduit 355 and connects the sixth fluid conduit 356 to the fluid reservoir t34 for tilting the object 309 clockwise. Moving the third three-position valve 75 to a third position 78 connects the fluid pressure source 33 to the sixth fluid conduit 356 and connects the fifth fluid conduit 355 to the fluid reservoir t34 for tilting the planar device 303 counterclockwise.

Moving three-position valve 85 to a first position 86 connects the pressure source 33 to conduit 357 and to chambers 316 and 326 in cylinders 310 and 320, and to chambers 335 and 345 in cylinders 330 and 340, and connects conduit 358 to the reservoir 34, respectively lowering element 307 and raising element 309.

Moving three-position valve 85 to third position 88 connects pressure source 33 to conduit 358 and the reservoir to conduit 357 for respectively raising element 307 and lowering element 309 by equal amounts.

First 361, third 363, fourth 364, fifth 365, sixth 366, seventh 367 and eighth 368 pilot check valves connected respectively to the first, third, fourth, fifth, sixth, seventh and eighth fluid conduits near the three-position valves open respective ones of the check valves when the first three-position valve 35 is in the third position 38, or when the second 65, third 75 or fourth 85 check valve is either in the first 66, 76, 86 or third position 68, 78, 88.

The machine may be a long press brake such as a twelve meter press brake with four driven rams.

When using in a long or shear press brake, elements 307 and 309 are connected, and tilting the connected elements requires opening valves 65, 75 and 85 at the same time. For example, when valve 85 is moved to position 86 to move the right rams 337 and 347 up and the left rams 317 and 327 down at the same time, valve 75 is moved to position 78 to relatively move rams 347 up and 337 down, and valve 65 is moved to position 68 to relatively move ram 37 down and ram 327 up.

Valves 35, 65, 75 and 85 are moved between positions by solenoids 39, 69, 79, 89 under control of a computer to move the rams.

While the invention has been described with reference to specific embodiments, modifications and variations of the invention may be constructed without departing from the scope of the invention, which is defined in the following claims.

I claim:

1. A system for controlling movement of machine parts, comprising:

a fixed machine part;

a movable machine part;

first and second rams connected to the movable machine part;

first and second cylinders connected respectively to the first and second rams;

first and second opposed drive chambers in each of the cylinders;

third and fourth opposed equalizing chambers in each of the cylinders;

a fluid pressure source and a fluid receiver;

a three-position four-way valve;

fluid interconnections between the fluid pressure source and the three-position four-way valve and between the fluid receiver and the three-position four-way valve;

a first fluid conduit between the three-position valve and the first drive chambers;

a second fluid conduit between the second drive chambers and the three-position valve;

a third fluid conduit between the third chamber of the first cylinder and the fourth chamber of the second cylinder; and a fourth fluid conduit between the fourth chamber of the first cylinder and the third chamber of the second cylinder for equalizing movement of the first and second rams, further comprising a second three-position four-way valve connected to the fluid pressure source and to the fluid receiver and the third and fourth fluid conduits for tilting opposite sides of the movable machine part upward and downward when the second three-position valve is in a first position or in a third position.

2. The system of claim 1, wherein the first and second opposed drive chambers are outer chambers in the cylinders, further comprising a pilot check valve connected in the first conduit adjacent the three-position four-way valve for allowing fluid to flow from the pilot check valve to the first chambers when the three-position valve is in a first position.

3. The system of claim 2, wherein the pilot check valve has a pilot line connected to the second fluid conduit near the three-position valve, wherein the three-position valve is in a third position, pressure from the pressure source opens the check valve to permit fluid to flow from the first conduit to the fluid receiver.

4. The system of claim 1, wherein in each of the cylinders the first chambers and third chambers are separated by a first movable piston, the second and fourth chambers are separated by a second movable piston, wherein the third and fourth chambers are separated by a divider fixed in each of the cylinders, and wherein the first and second pistons are connected to one of the rams and the one of the rams is movable through and is sealed for movement in the divider.

5. The system of claim 1, wherein the machine is a press, shear or press brake.

6. The system of claim 1, further comprising third and fourth pilot check valves connected in the third and fourth conduits near the second three-position valve.

7. A system for controlling movement of a movable plane in a machine having stationary and movable planes, comprising:

a movable plane;

first, second, third and fourth cylinders;

first, second, third and fourth rams in the first, second, third and fourth cylinders connected to the movable plane remote from each other to move the movable plane between parallel positions and to selectively rotate the movable plane around crossed axes;

first and second opposed drive chambers in each of the cylinders;

third and fourth equalizing chambers in each of the cylinders;

a fluid pressure source and a fluid receiver;

first, second and third three-position four-way valves connected to the fluid pressure source and the fluid receiver;

first and second fluid conduits connected to the first three-position valve;

third and fourth fluid conduits connected to the second three-position valve;

fifth and sixth fluid conduits connected to the third three-position valve;

the first fluid conduit being connected to the first chambers in the first, second, third and fourth cylinders;

the second fluid conduit being connected to the second chambers in the first, second, third and fourth cylinders;

the third fluid conduit being connected between the third chamber in the first cylinder and the fourth chamber in the third cylinder;

the fourth fluid conduit being connected between the fourth chamber in the first cylinder and the third chamber in the third cylinder;

the fifth fluid conduit being connected between the third chamber in the second cylinder and the fourth chamber in the fourth cylinder;

the sixth fluid conduit being connected between the fourth chamber in the second cylinder and the third chamber in the fourth cylinder;

wherein placing the first three-position valve in a first position connects the fluid pressure source to the first conduit and to all of the first chambers, and connects the second conduit and all of the second chambers to the fluid reservoir, to provide movement of the movable plane in a first direction while fluid flows in the third, fourth, fifth and sixth conduits between the respective third and fourth chambers of the cylinders to equalize movement of the rams;

wherein placing the first three-position valve in a third position connects the fluid pressure source to the second conduit and to all of the second chambers, and connects the first conduit and all of the first chambers to the fluid reservoir, to provide movement of the movable plane in a second direction opposite to the first direction while fluid flows in the third, fourth, fifth and sixth conduits between the respective third and fourth chambers of the cylinders to equalize movement of the rams.

8. The system of claim 7, further comprising moving the second three-position valve to a first position for connecting the fluid pressure source to the third fluid conduit, and connecting the fourth fluid conduit to the fluid reservoir for tilting the movable plane clockwise about a first axis between connections of the second and fourth rams to the movable plane, and moving the second three-position valve to a third position connects the fluid pressure source to the fourth fluid conduit, and connects the third fluid conduit to the fluid reservoir for tilting the movable plane counterclockwise about the first axis between the connections of the second and fourth rams to the movable plane.

9. The system of claim 7, further comprising moving the third three-position valve to a first position for connecting the fluid pressure source to the fifth fluid conduit, and connecting the sixth fluid conduit to the fluid reservoir for tilting the movable plane clockwise about a second axis between connections of the first and third rams to the movable plane, and moving the third three-position valve to a third position for connecting the fluid pressure source to the sixth fluid conduit, and connecting the fifth fluid conduit to the fluid reservoir for tilting the movable plane counterclockwise about the second axis between the connections of the first and fourth rams to the movable plane.

10. The system of claim 7, wherein in each of the cylinders the first chambers and third chambers are separated by a first movable piston, the second and fourth chambers are separated by a second movable piston, wherein the third and fourth chambers in each cylinder are separated by a divider fixed in each cylinder, and wherein the first and second pistons in each cylinder are connected to one of the rams and the rams are movable through and sealed for movement in the dividers.

11. The system of claim 7, wherein the machine is a press and the movable plane is a platen.

12. A system for moving movable objects in parallel spaced positions by equalizing movement of rams with an ability to rotate the objects in shaping sheet metal for automobiles or in long twelve meter press brakes and moving objects in a machine having multiple movable objects, comprising:

fixed first, second, third and fourth cylinders, first, second, third and fourth rams mounted in the cylinders and connected to the movable objects, first and second opposed drive chambers are in each of the cylinders, four equalizing chambers in each of the cylinders, first, second, third and fourth three-position four-way valves connected to a fluid pressure source and a fluid receiver tank, first and second fluid conduits connected to the first three-position valve, third and fourth fluid conduits connected to the second three-position valve, fifth and sixth fluid conduits connected to the third three-position valve, seventh and eighth fluid conduits connected to the fourth three-position valve, the first fluid conduit being connected to the first chambers in the first, second, third and fourth cylinders, the second fluid conduit being connected to second chambers in the first, second, third and fourth cylinders, the third fluid conduit being connected between a third chamber in the first cylinder and a fourth chamber in the second cylinder, the fourth fluid conduit being connected between a fourth chamber in the first cylinder and a third chamber in the second cylinder, the fifth fluid conduit being connected between a third chamber in the third cylinder and the fourth chamber in the fourth cylinder, the sixth fluid conduit being connected between a fourth chamber in the third cylinder 330 and a third chamber in the fourth cylinder, the seventh fluid conduit being connected to sixth chambers in the first and second cylinders, and to the fifth chambers in the third and fourth cylinders, the eighth fluid conduit being connected to fifth chambers in the first and second cylinders, and to sixth chambers in the third and fourth cylinders, the second positions of the three-position valves being neutral with no connection to the chambers, placing the first three-position valve in a first position connecting the fluid pressure source to the first conduit and to all of the first chambers and connecting the second conduit and all of the second chambers to the fluid reservoir to provide outward movement of the movable objects, fluid flowing in the third, fourth, fifth and sixth conduits between the respective third and fourth chambers of the cylinders and in the seventh and eighth conduits between respective fifth six sixth chambers to equalize movement of the rams, placing the first three-position valve in a third position connecting the fluid pressure source to the second conduit and to all of the second chambers, connecting the first conduit 31 and all of the first chambers to the fluid reservoir, and providing inward movement of the movable objects, and flowing fluid in the third, fourth, fifth and sixth conduits between the respective third and fourth chambers of the cylinders and in the seventh and eighth conduits between respective fifth six sixth chambers to equalize movement of the rams.

13. The system of claim 12, wherein moving the second three-position valve to a first position connects the fluid pressure source to the third fluid conduit and connects the fourth fluid conduit to the fluid reservoir for tilting the object clockwise, moving the second three-position valve to a third position connects the fluid pressure source to the fourth fluid conduit and connects the third fluid conduit to the fluid reservoir for tilting the object counterclockwise, moving the third three-position valve to a first position connects the fluid pressure source to the fifth fluid conduit and connects the sixth fluid conduit to the fluid reservoir for tilting the object clockwise, and moving the third three-position valve to a third position connects the fluid pressure source to the sixth fluid conduit and connects the fifth fluid conduit to the fluid reservoir for tilting the movable objects counterclockwise.

* * * * *